US008176586B2

(12) United States Patent
Berke et al.

(10) Patent No.: US 8,176,586 B2
(45) Date of Patent: May 15, 2012

(54) ARM-POSITIONING CUSHION AND PILLOW

(76) Inventors: Joseph J. Berke, West Bloomfield, MI (US); Jason Berke, West Bloomfield, MI (US)

( * ) Notice: Subject to any disclaimer, the term of this patent is extended or adjusted under 35 U.S.C. 154(b) by 0 days.

(21) Appl. No.: 12/234,959

(22) Filed: Sep. 22, 2008

(65) Prior Publication Data

US 2010/0242179 A1 Sep. 30, 2010

(51) Int. Cl.
*A47C 20/00* (2006.01)

(52) U.S. Cl. ..... 5/636; 5/639; 5/645

(58) Field of Classification Search ..... 5/630, 636–640, 5/643, 645, 733, 652, 655.9, 632, 727–730; D6/595, 596, 601
See application file for complete search history.

(56) References Cited

U.S. PATENT DOCUMENTS

| | | | | |
|---|---|---|---|---|
| D114,973 | S | 5/1939 | Eckman | |
| D118,319 | S | 12/1939 | Kandell | |
| 2,835,905 | A | 5/1958 | Tomasson | |
| 3,064,279 | A | 11/1962 | Finkle | |
| 3,403,414 | A | 10/1968 | Unger | |
| 3,757,365 | A | 9/1973 | Kretchmer | |
| D260,591 | S | 9/1981 | Eischen | |
| 4,432,107 | A | 2/1984 | Clark | |
| D279,344 | S | 6/1985 | Kohler, Jr. | |
| D284,724 | S | 7/1986 | Clark | |
| D308,613 | S | 6/1990 | Clark | |
| D310,609 | S | 9/1990 | Burkhardt | |
| D317,840 | S | 7/1991 | Jagdat | |
| 5,214,814 | A * | 6/1993 | Eremita et al. | 5/636 |
| D337,017 | S | 7/1993 | Levien | |
| D337,231 | S | 7/1993 | Levien | |
| 5,638,564 | A | 6/1997 | Greenwalt | |
| 5,644,809 | A * | 7/1997 | Olson | 5/636 |
| 5,727,267 | A | 3/1998 | Keilhauer | |
| D444,980 | S | 7/2001 | Mowat | |
| D449,482 | S | 10/2001 | Berke | |
| D449,483 | S | 10/2001 | Berke | |
| D449,484 | S | 10/2001 | Berke | |
| 6,336,236 | B1 * | 1/2002 | Dalton | 5/636 |
| 6,484,336 | B1 | 11/2002 | Berke | |
| D502,038 | S | 2/2005 | Berke | |
| D575,566 | S | 8/2008 | Berke | |

* cited by examiner

*Primary Examiner* — Robert G Santos
*Assistant Examiner* — Nicholas Polito
(74) *Attorney, Agent, or Firm* — Butzel Long

(57) ABSTRACT

An ergonomic, arm-positioning pillow includes an ornamental design including an upper portion having a top surface for supporting the head of a sleeper and a bottom portion having a lower surface for supporting the arm-positioning pillow and having a first space extending at an oblique angle from a first space located along the lower surface for receiving an arm therein and supporting the sleeper to position the arm for managing the amount of pressure applied to the arm, and a second space located in the lower surface for receiving a second arm or for receiving the second arm to provide for ambidextrous use of the arm-positioning pillow and to obtain improved sleep performance in the form of reduced snoring and sleep apnea.

12 Claims, 15 Drawing Sheets

FIG - 20
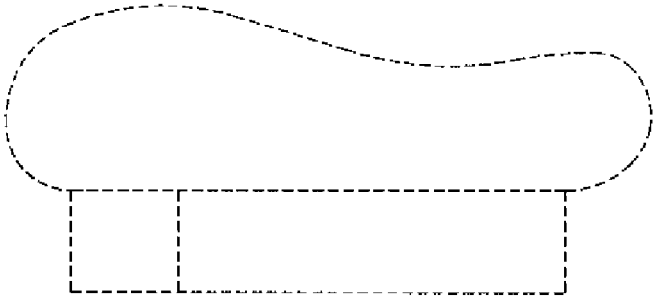
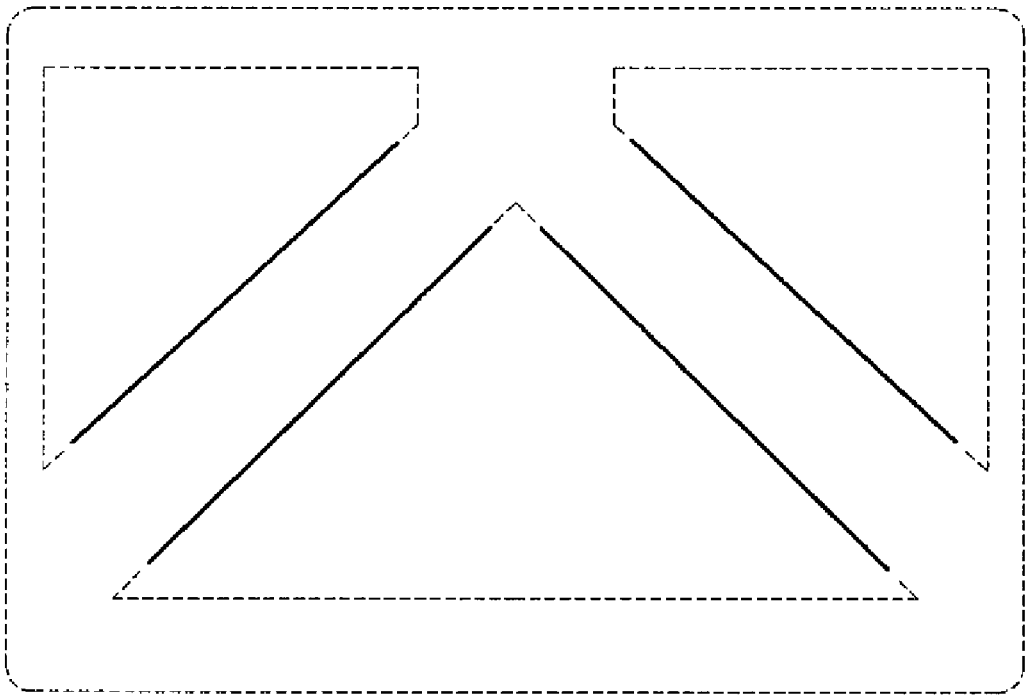
FIG - 21

FIG - 25
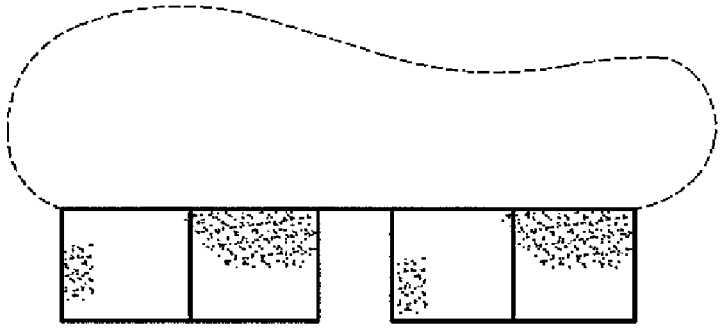
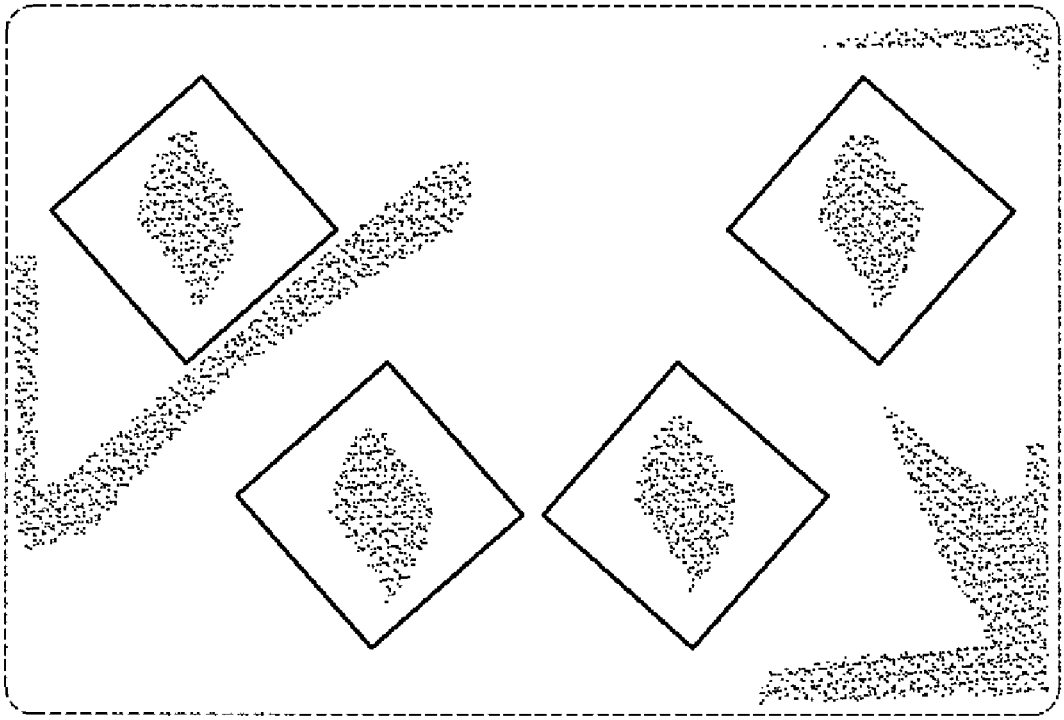
FIG - 26

FIG - 32
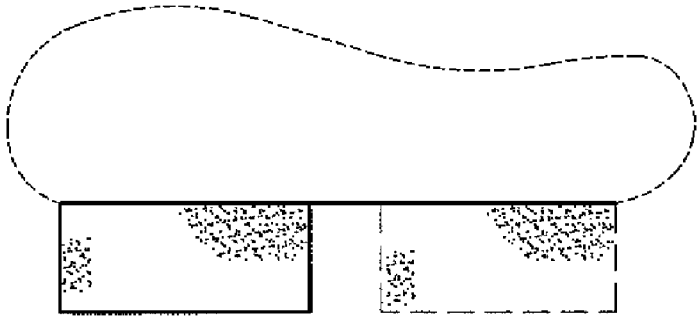
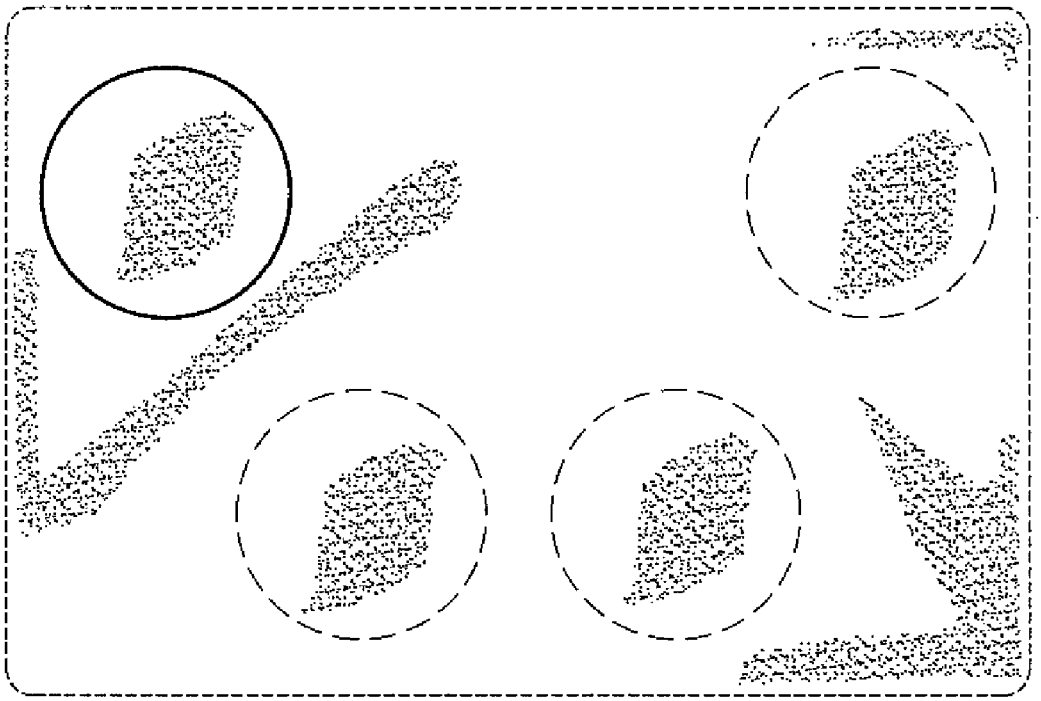
FIG - 33

ARM-POSITIONING CUSHION AND PILLOW

BACKGROUND

The present disclosure relates to an arm-positioning cushion or pillow for improving sleep performance and resting comfort of a person who generally sleeps prone or on their side.

Generally, the quality and quantity of sleep affects mental and physical health and feelings of well being. Many individuals prefer to sleep on their side ("side sleepers") or in a side/prone position rather than in a complete prone or complete supine position. This side sleeper preference is primarily for comfort, although may also be preferred due to improved quality and quantity of sleep which may improve mental and physical health aspects such as obesity, impairment to sleep quality due to mild sleep apnea and/or snoring, habit, or illness among other reasons. Accordingly, there remains a desire to improve the quality and quantity of sleep a person may obtain. In particular there remains a continuing need to provide a sleeper improved and greater flexibility in slide sleeping positions while maintaining and/or improving support and comfort to help a sleeper maintain a sleep position such as by limiting or reducing compression of the sleeper's upper extremities.

Traditional pillows do not adequately provide for a sleeper's needs or comfort. When a sleeper's head, or head and pillow, rest on the arm and/or shoulder (especially after extended periods of recumbence) pain, dysesthesias and paresthesias frequently occur. This discomfort and annoyance due to these conditions may cause the side sleeper to change positions frequently, causing the sleeper to awaken, and thereby diminish the quality and quantity of sleep. Chronic restlessness and wakefulness may lead to sleep deprivation with subsequent diurnal fatigue, depression and other side effects.

U.S. Pat. No. 6,484,336 discloses a known embodiment of an ergonomic pillow. While the disclosure of the '336 patent represented an improvement in the state of the art at the time, there remains a continuing need to provide additional comfort devices and especially for an improved arm-positioning pillow or cushion for a side sleeper and those requiring versatility in their sleeping positions. There is a continuing need to provide greater utility when compared to conventional pillows.

SUMMARY

One exemplary embodiment of the present disclosure relates to ergonomic arm-positioning pillows and cushions that may be used for reducing the pressure on a user's left or right arm (and both) and may be used in multiple positions. The arm-positioning pillows and cushions position the arm to reduce discomfort and restlessness, and to improve the quality and quantity of sleep. Various positions are considered for accommodating the side sleeper's head, neck, shoulder and arm to lessen nocturnal compression of the arm and shoulder. It is a further objective to provide arm-positioning, comfortable pillows and cushions which are multi-functional and multi-positionable to accommodate various sleeper positions and recumbent activities.

BRIEF DESCRIPTION OF THE DRAWINGS

The foregoing and other features of the exemplary embodiments will become more apparent to one skilled in the art upon consideration of the following detailed description and the accompanying drawings in which:

The foregoing and other features of the exemplary embodiments will become more apparent to one skilled in the art upon consideration of the following detailed description and the accompanying drawings in which:

FIG. 20 is a rear view thereof;

FIG. 21 is a bottom view thereof.

FIG. 25 is a rear view thereof;

FIG. 26 is a bottom view thereof.

FIG. 32 is a rear view thereof;

FIG. 33 is a bottom view thereof.

DETAILED DESCRIPTION

Figure 1:
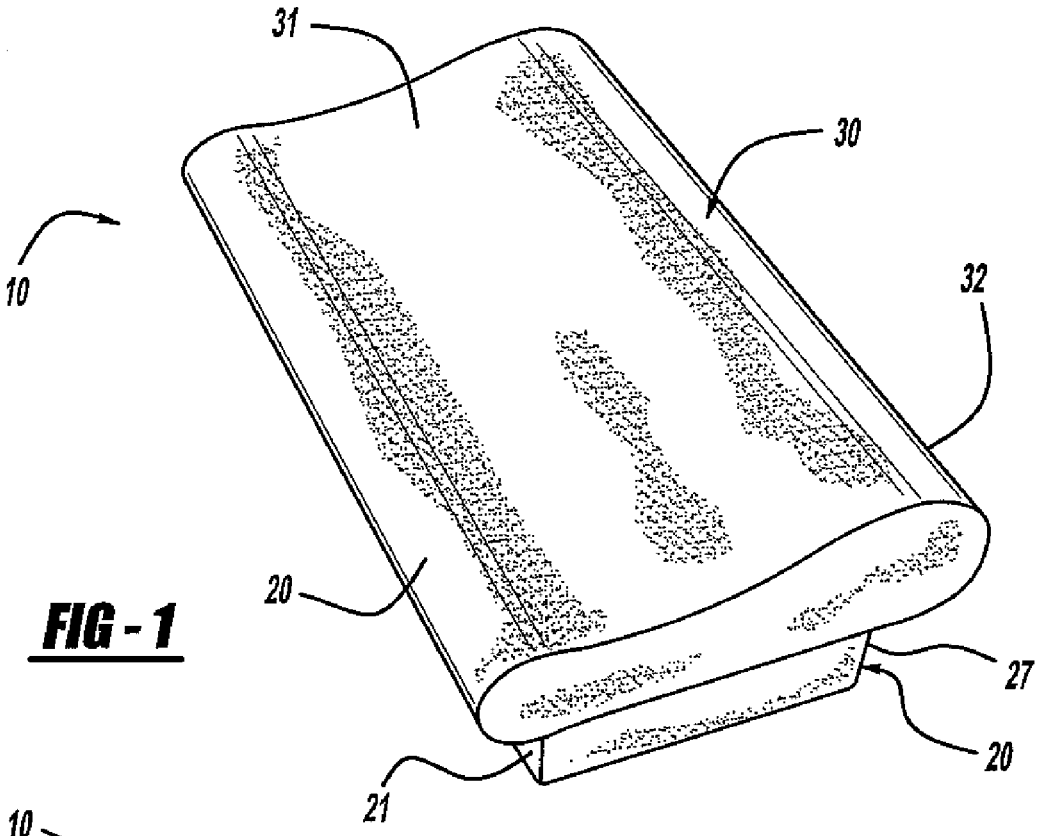
FIG. 1 is an isometric view of a side sleeper pillow according to the present disclosure.
Figure 2:
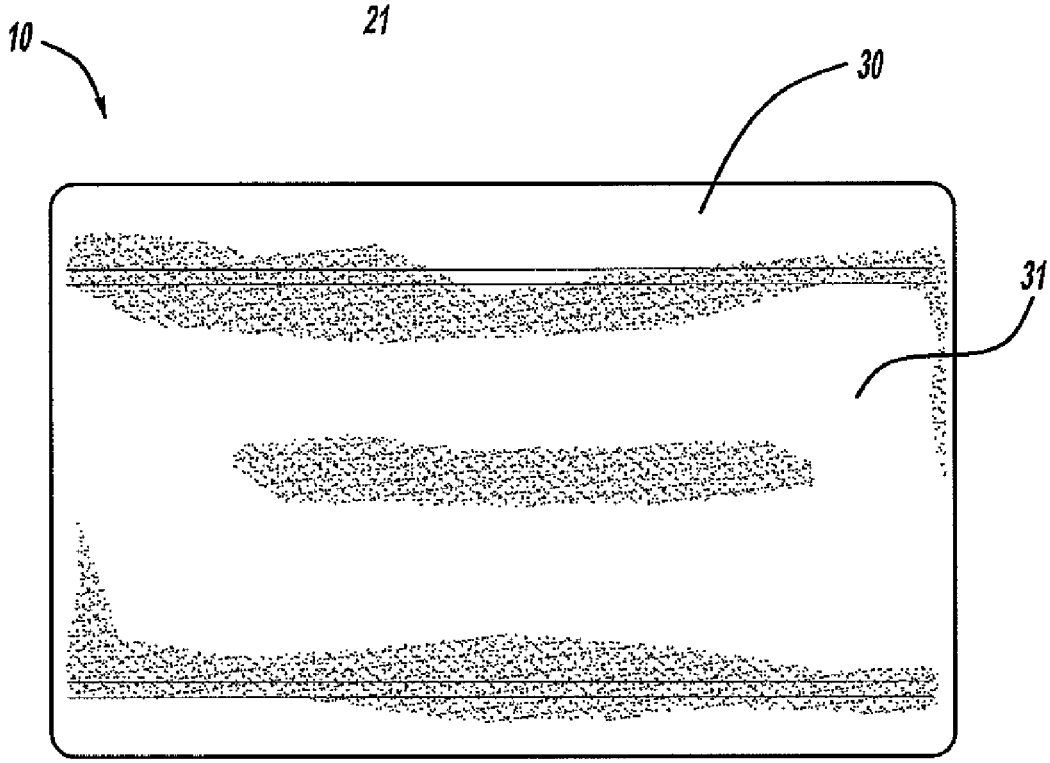
FIG. 2 is a top view of a side sleeper pillow according to the present disclosure.
Figure 3:
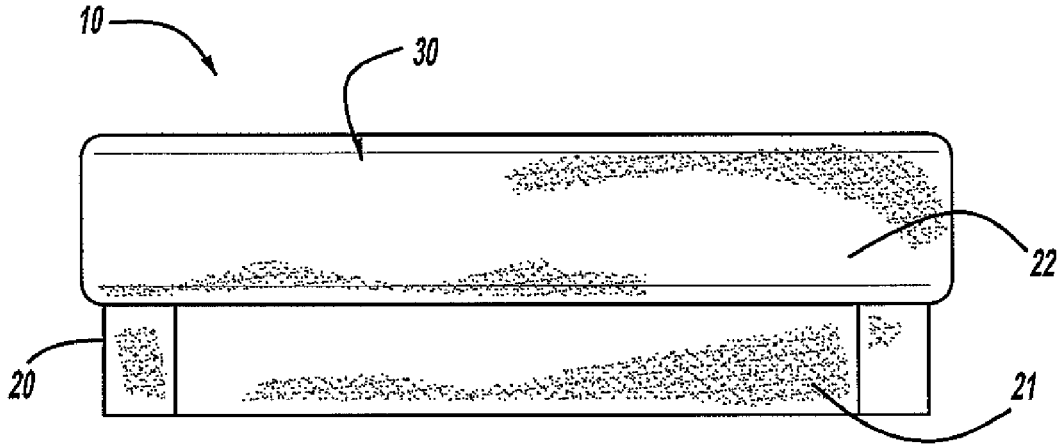
FIG. 3 is a first end view of a side sleeper pillow according to the present disclosure.
Figure 4:
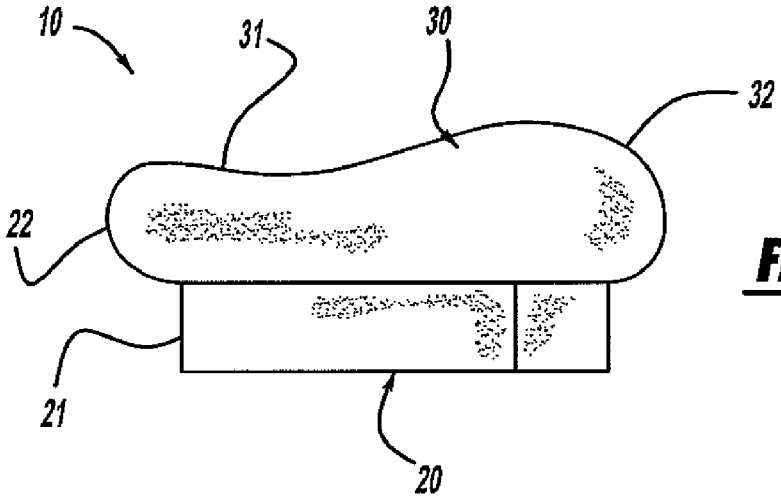
FIG. 4 is a second end view of a side sleeper pillow according to the present disclosure.
Figure 5:
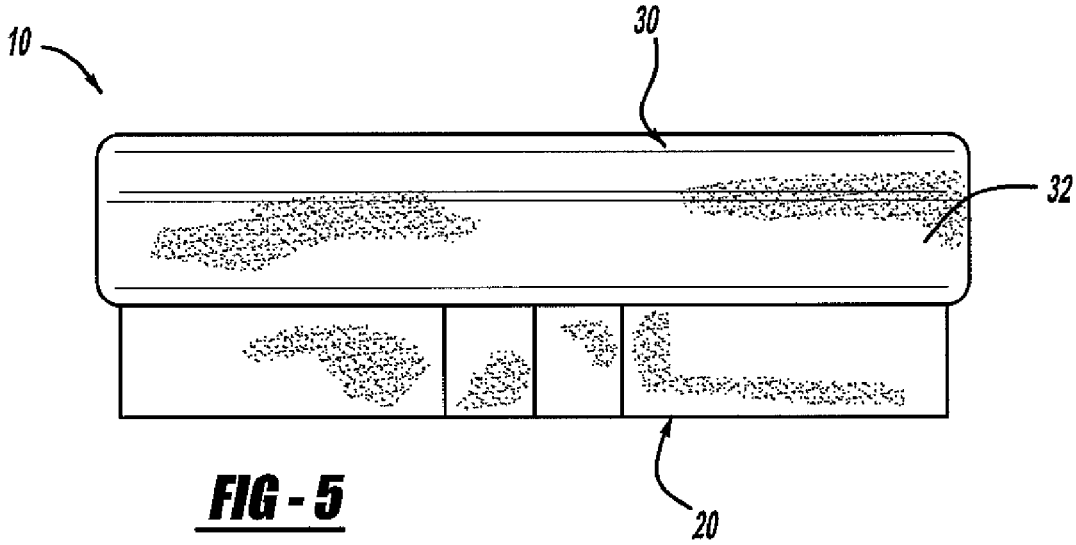
FIG. 5 third end view of a side sleeper pillow according to the present disclosure.
Figure 6:
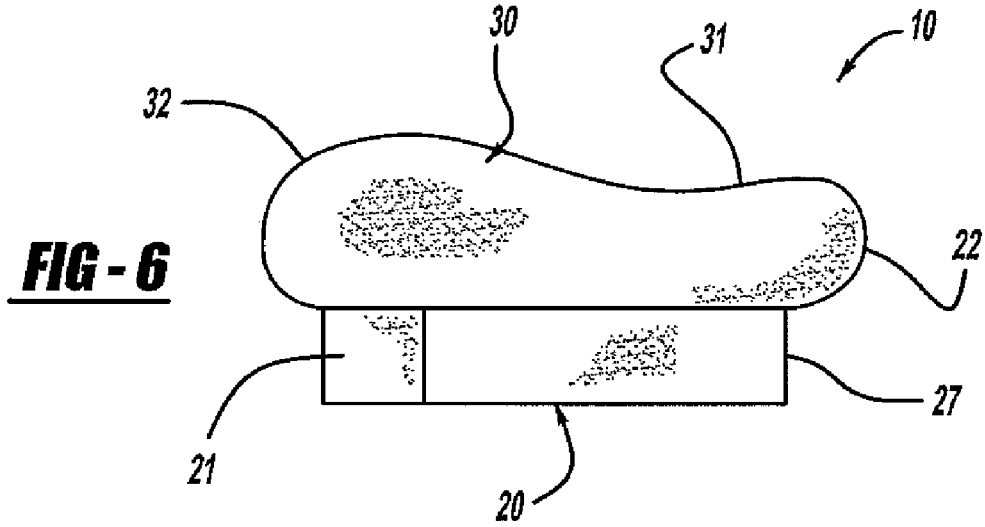
FIG. 6 is a fourth end view of a side sleeper pillow according to the present disclosure.

Referring to generally to all of the figures and in particular to FIGS. 1 through 13, a generally rectangular shaped therapeutic pillow 10 is shown, for improving the quality and quantity of sleep of side sleepers. The therapeutic pillow 10 has greater utility. Therapeutic pillow 10 is optimally used by side sleepers who like to position an arm under their head. However, due to discomfort, such side sleepers periodically become restless and are awakened because of arm pain, dysesthesias and paresthesias.

With particular reference to FIGS. 1, 3, 4, 6 and 7, the therapeutic pillow 10 may have any known and/or appropriate overall pillow shape, such as the rectangular shape shown in the FIGs, or other shapes including square, round, oblong, elliptical, etc. The pillow 10 is usable by an individual with the right arm, the left arm and both arms as may be desired. Further, the pillow 10 may be used from multiple positions as will be understood from the below description. The pillow 10 may be enclosed in any usual type of slip cover (not shown), which may be opened and closed at one end by a closure such as buttons, VELCRO® or a zipper as is well known. The therapeutic pillow 10 includes a generally resilient but more firm pillow base portion 20 and a generally more resilient pillow top portion 30. The pillow base portion 20 includes a first front lower portion 21 of the pillow 10 offset inwardly from a front upper portion 22 of the pillow top portion 32. The lower recessed portion 21 is more fully disclosed in U.S. Pat. No. 6,484,336, the disclosure of which is incorporated herein. The lower recessed portion 21 provides a protected space for the side sleeper's arms and prevents the sleeper's head from loading the arm and inducing pain, dysesthesias and paresthesias. The protected space which is parallel to the front surface of the pillow is adapted to accommodate a side sleeper's arm when the head of the side sleeper is resting on the generally planar top surface 31 of the pillow 10. This position leads to a relief or reduction of related aches and pains and thereby reduces tossing and turning, allowing the side sleeper improved rest. The pillow 10 may be used with either the left or right arms of the sleeper.

Figure 7:
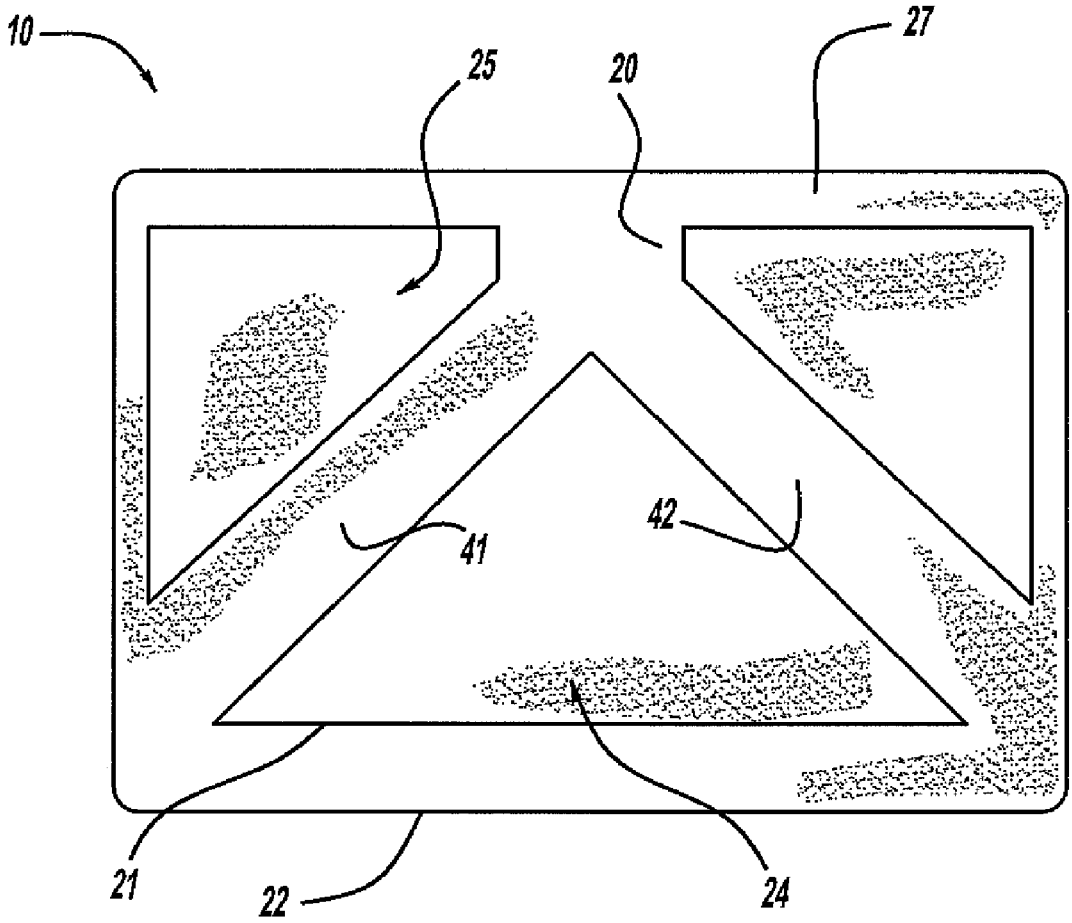
FIG. 7 is a bottom view of a side sleeper pillow according to the present disclosure.

With particular reference to FIG. 7, the bottom of the pillow 10 is shown wherein a first and second recess 41 and 42, respectively, are shown as being defined by a plurality of base supports or members 24, 25, and 26. The first and second recesses 41 and 42, respectively, define a recess 43 that is shown as being preferably angled (i.e., substantially "v" shaped) in this embodiment and which allows an arm of the side sleeper to pass at an angle of approximately 45 degrees from the X-direction, which may be a direction of sleep of a user of the pillow 10 including a side sleeper, as represented by the line X-X in FIG. 7. The direction of sleep X extends substantially perpendicular or normal and through the center of the pillow or offset and substantially aligned therewith. The first and second recesses 41 and 42, respectively, provide a side sleeper the opportunity to keep the sleeper's head in the middle area of the top surface 31 while inducing the sleeper to space the sleeper's head apart from the sleeper's arm and yet still allowing the side sleeper to have some feel that the sleeper's head is pressing some on the sleeper's arm. Alternatively, it should be noted that the sleeper may optionally use the pillow 10 from either side of the direction of sleep X-X thereby providing even greater flexibility in adjusting the performance and comfort of the pillow 10 by providing the sleeper greater flexibility in the position of the sleepers arms. Even more optimally, the sleeper may optionally use the pillow to achieve a better balance of performance factors that will provide a side sleeper with a more optimal sleeping experience and comfort and will provide a more sound and restful sleep.

Further, the first and second recesses 41 and 42, respectively, allow the side sleeper many more sleeping positions than known therapeutic pillows as the sleeper may have a side sleeping arm in either the first recess 41 or the second recess 42 and thus angled in front of or behind the sleeper's head when it is located in the center portion of the top planar surface 31. Further, the pillow 10 may alternatively be used by a prone sleeper (front or back) to have the sleeper's arms in one or both of the first and second recesses 41 and 42, respectively, to provide alternative comfort sleep positions.

Figure 8:
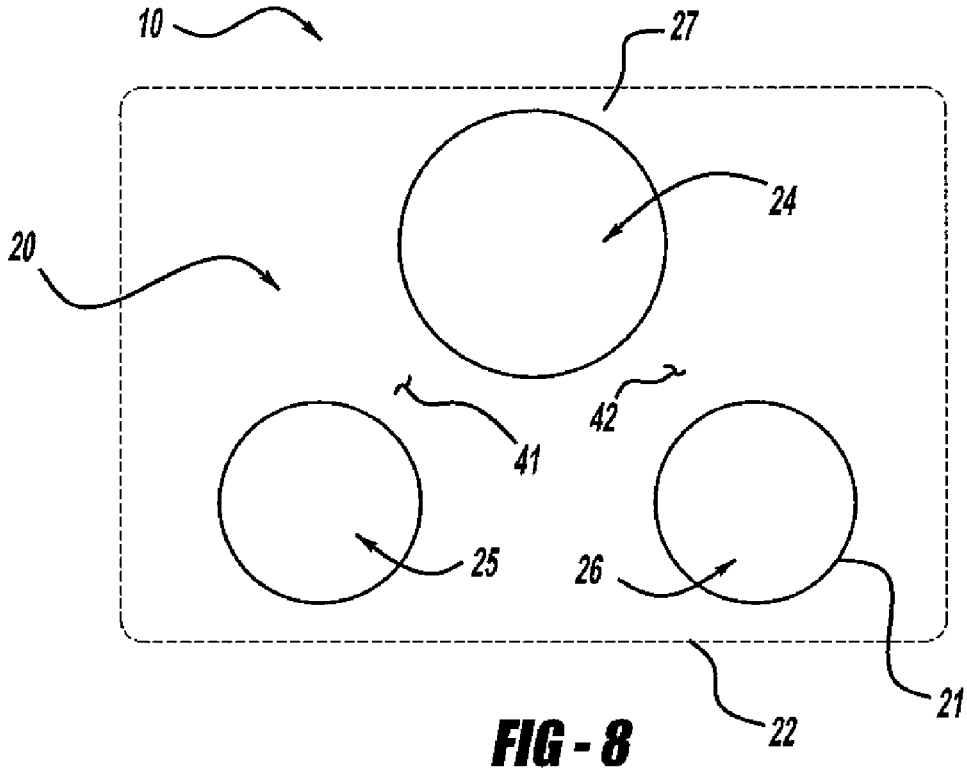
FIG. 8 is a bottom view of a side sleeper pillow having an alternate support base configuration according to the present disclosure.
Figure 9:
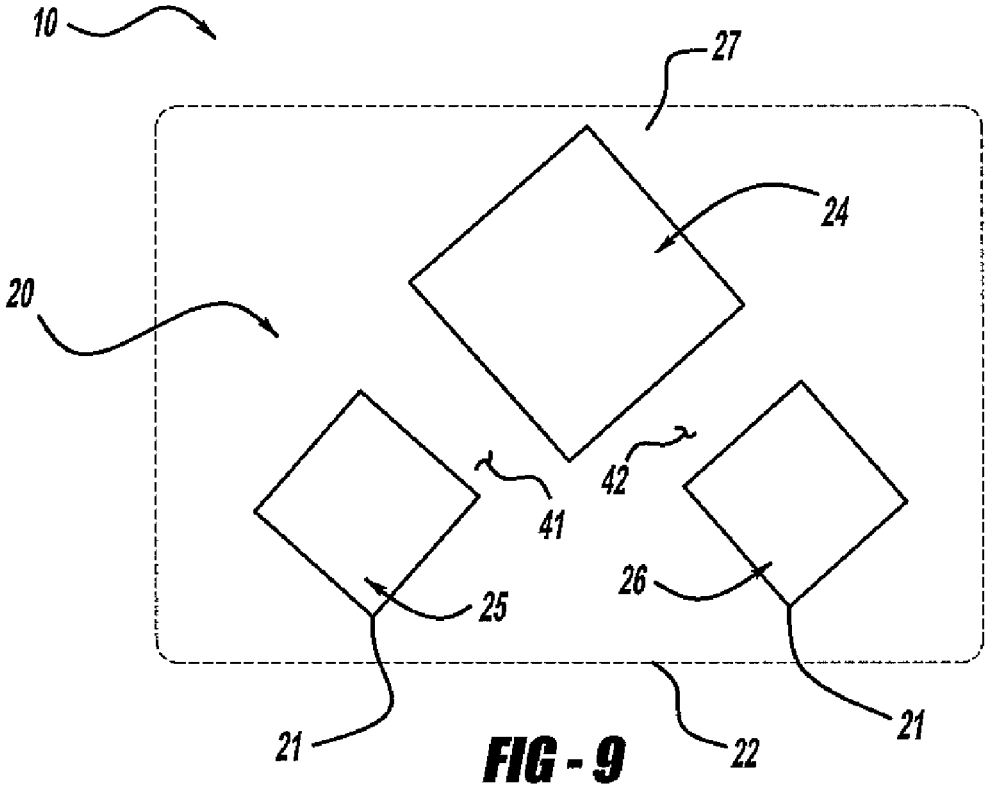
FIG. 9 is a bottom view of a side sleeper pillow having a further alternate support base configuration according to the present disclosure.
Figure 10:
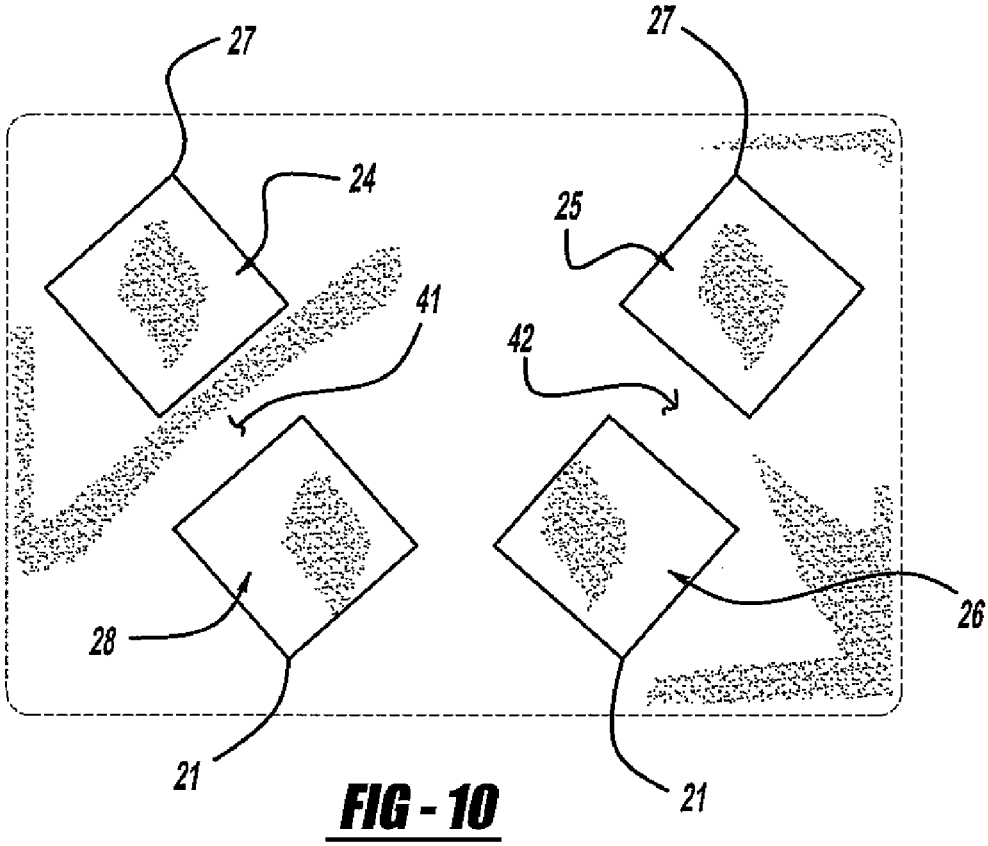
FIG. 10 is a bottom view of a side sleeper pillow having a further alternate support base configuration according to the present disclosure.
Figure 11:
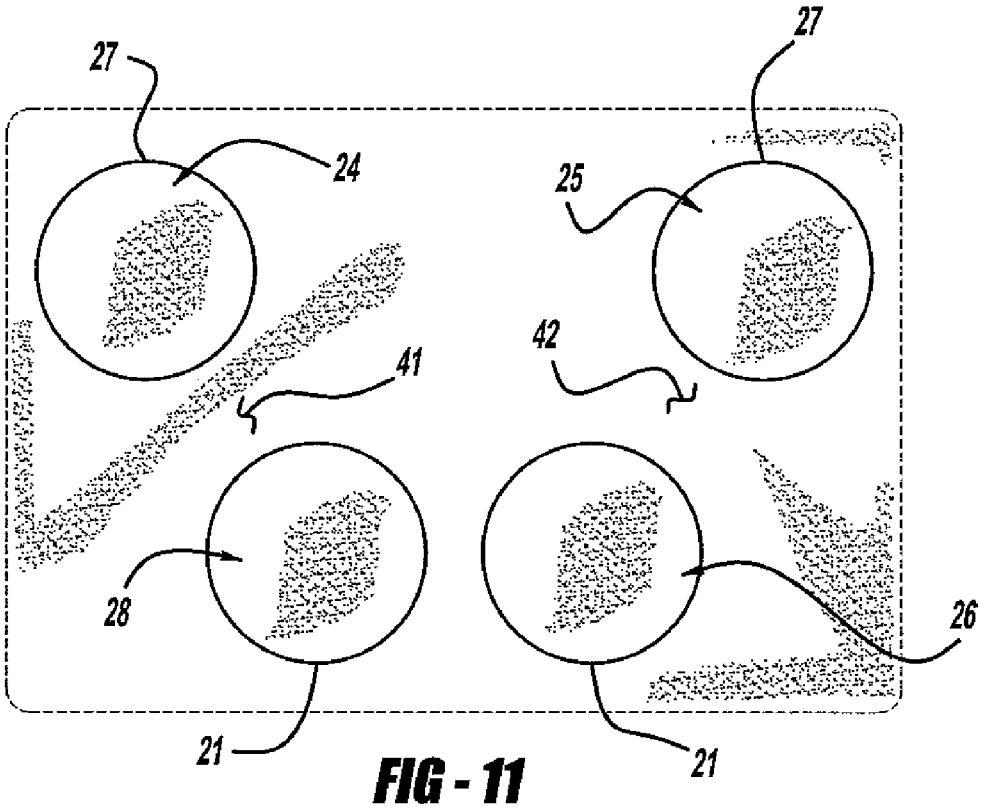
FIG. 11 is a bottom view of a side sleeper pillow having a further alternate support base configuration according to the present disclosure.

In one exemplary embodiment as shown best in FIG. 8, the therapeutic pillow 10 further includes a second lower portion 27 of the pillow 10 offset inwardly from a back upper portion 32 of the pillow top portion 30. The second lower portion 27 is further preferably defined by the base member 26. It should also be noted that the first lower portion 21 is at least partially defined by the base members 24 and 25. Further, the base members 24, 25, and 26, respectively, are each disclosed as having a generally triangular shape but may be selected to have any number of alternative shapes, designs and numbers of sides while still defining the first and second recesses 41 and 42, respectively, and the first and second lower portions 21 and 27, respectively. For example, as best shown in FIGS. 8 and 9, the shapes of the base members 24, 25 and 26 may be circular (FIG. 8) or rectangular (or square as shown in FIG. 9). The pillow 10 may also alternately be provided with more than the three disclosed base members 24, 25, and 26, while still providing the support and position options as disclosed for the three base members 24, 25, and 26. For example, as best shown in FIGS. 10 and 11, four base members 24, 25, 26 and 28 are provided in a configuration for providing support and an arm-positioning, therapeutic pillow 10 which may be used to position and protect either arm of a sleeper.

The construction and arrangement of the elements of the therapeutic pillow 10, including the base members 24, 25 and 26, as shown in the illustrated and other exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited herein. For example, while the three disclosed base members 24, 25, and 26, described herein are shown as being used in combination with the contoured pillow top portion 30, it should be understood that any contour, shape or form for the pillow top portion 30 may be utilized. The therapeutic pillow 10 may be constructed from any of a wide variety of appropriate materials that provide sufficient support, comfort and durability and in any of a wide variety of colors, combinations and suitable materials. Other substitutions, modifications, changes and omissions may be made in the design and arrangement of the preferred and exemplary embodiments without departing from the scope of the present disclosure.

Figure 12:
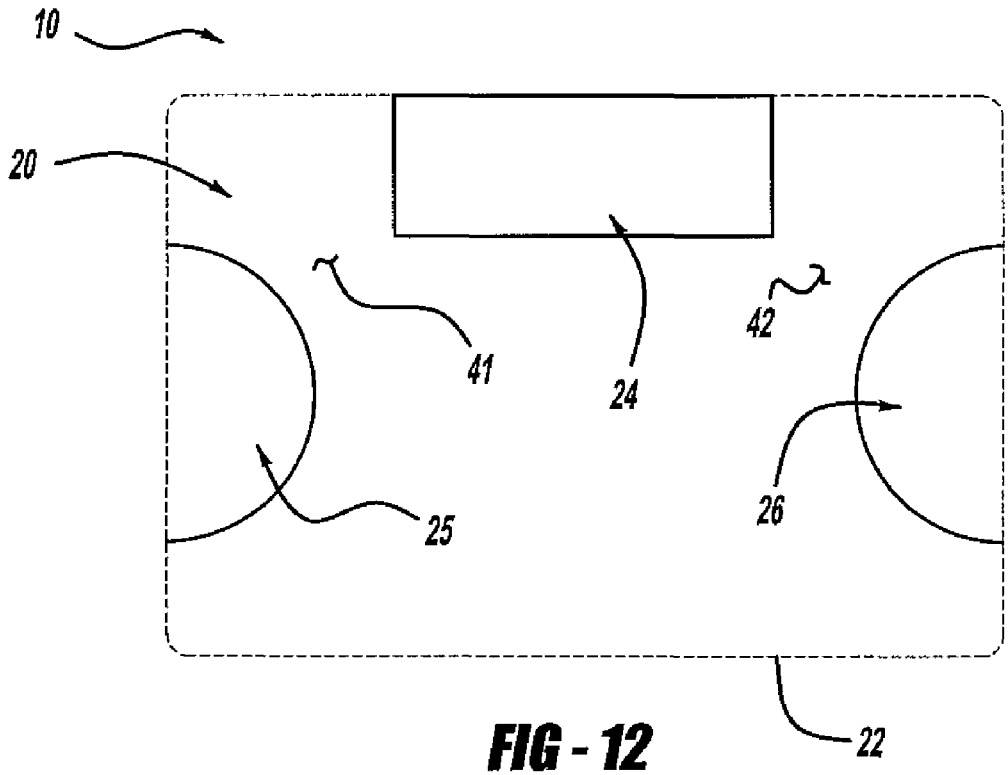
FIG. 12 is a bottom view of a side sleeper pillow having a further alternate support base configuration according to the present disclosure.
Figure 13:
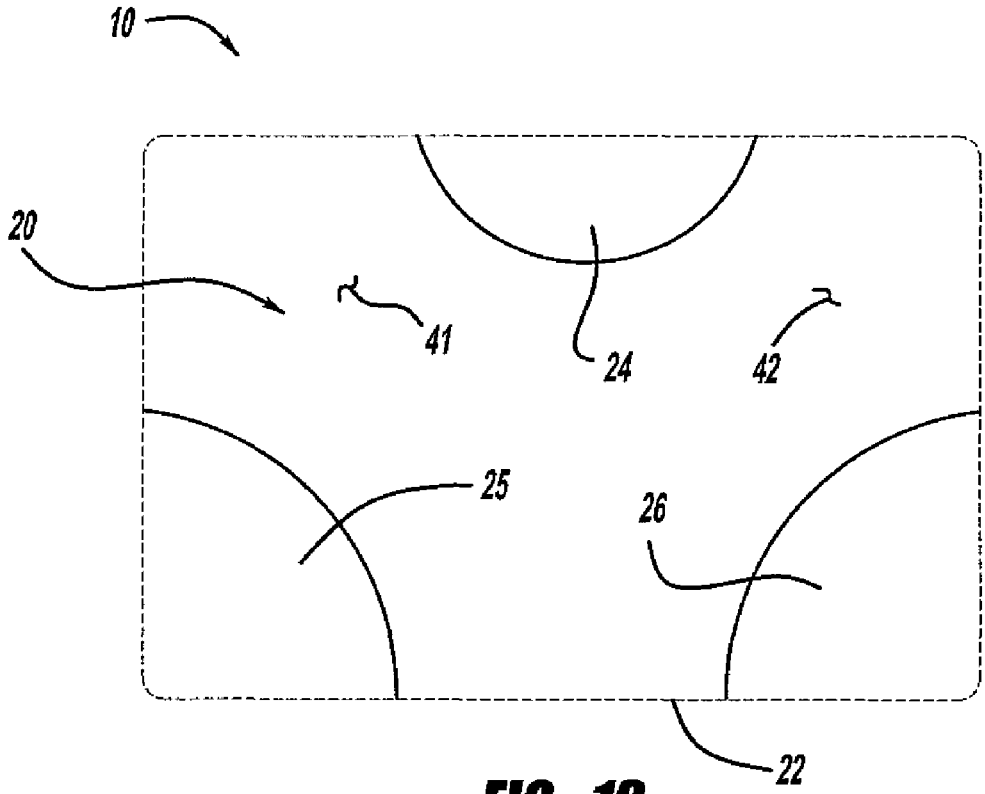
FIG. 13 is a bottom view of a side sleeper pillow having a further alternate support base configuration according to the present disclosure.

Referring now to FIGS. 12 and 13 further alternate embodiment of the therapeutic pillow 10 is shown. As shown in FIG. 12, base members (supports) 24 and 25 are disclosed as having a generally semi-circular shape and base member (support) 26 is disclosed as having a generally rectangular shape. Alternatively, as shown in FIG. 13, base members (supports) 24, 25, and 26 may have a generally semi-circular shape. The base members define first and second recesses 41 and 42 that define a generally v-shaped recess 43 which allows an arm of a sleeper to pass at an angle of approximately 45 degrees from the X-direction, which is the direction of sleep of a user of the pillow 10. For example, a prone sleeper may position his/the sleeper's head face down on base member (support) 24 and extend each of his/the sleeper's arms in the first and second recesses 41 and 42, respectively. Alternatively, a side sleeper may position his/the sleeper's head between base members (supports) 25 and 26 and extend his/the sleeper's arms in either the first or second recesses 41 and 42.

Figure 14:
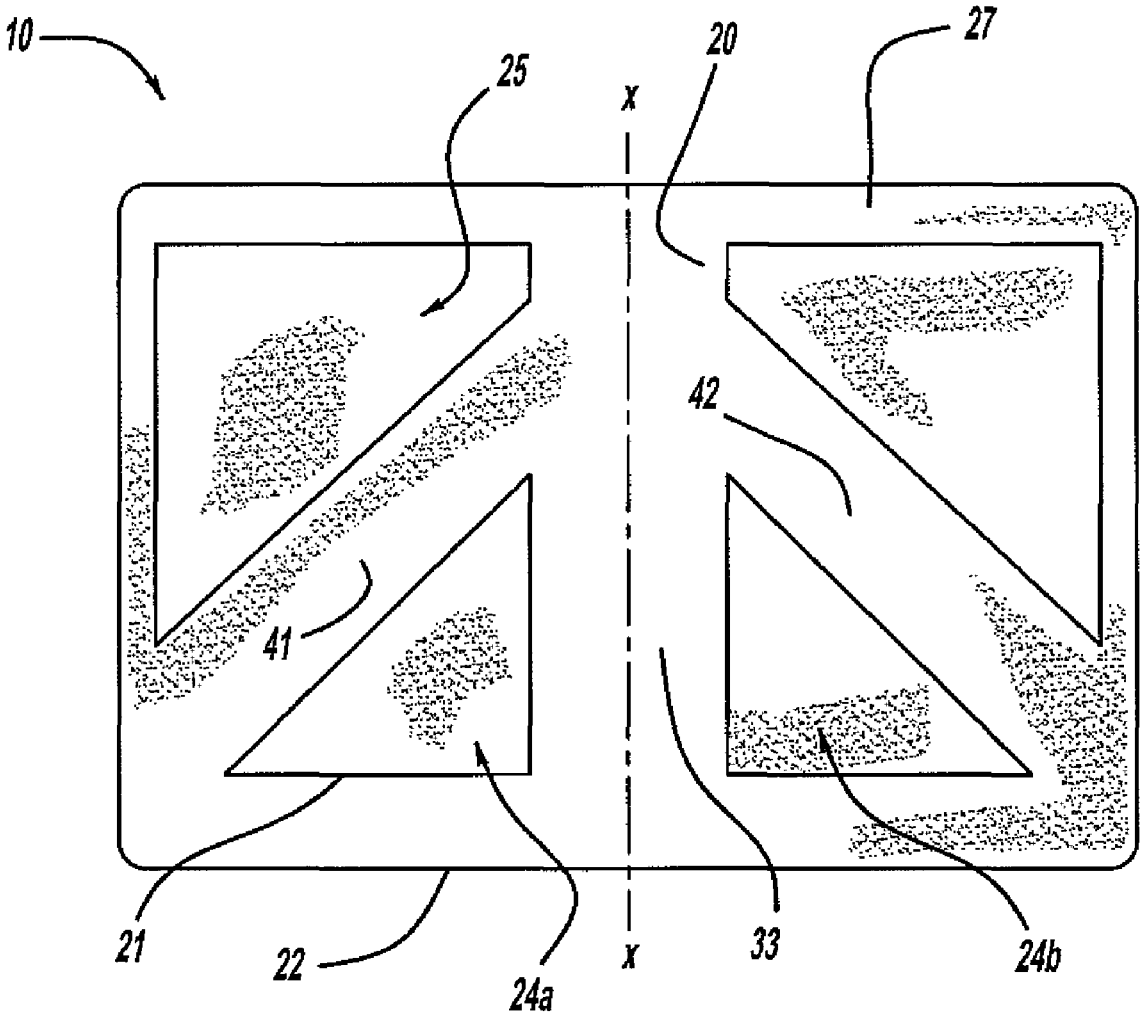
FIG. 14 is a bottom view of a side sleeper pillow having a further alternate support base configuration according to the present disclosure.
Figure 15:
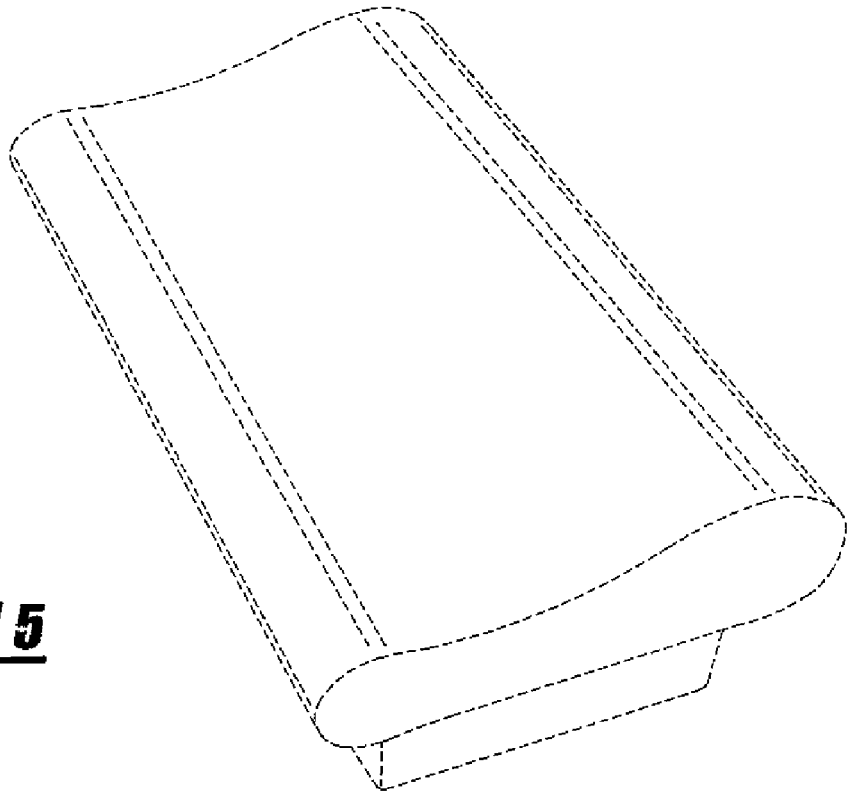
FIG. 15 is a first perspective view thereof.
Figure 16:
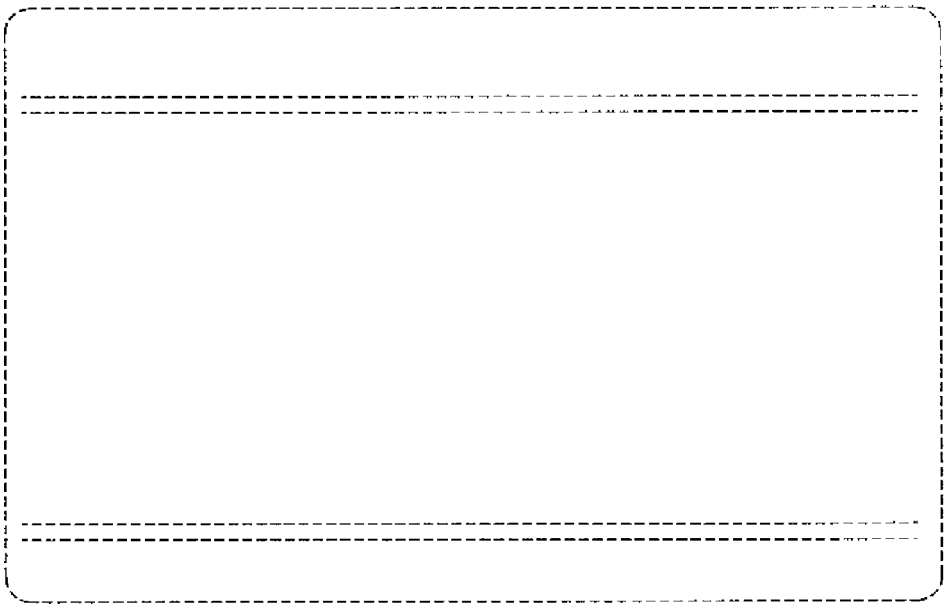
FIG. 16 is a first side view thereof.
Figure 17:
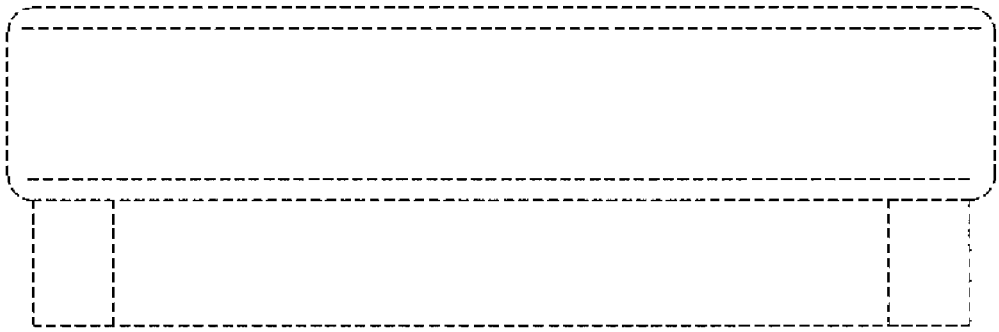
FIG. 17 is a first front view thereof.
Figure 18:
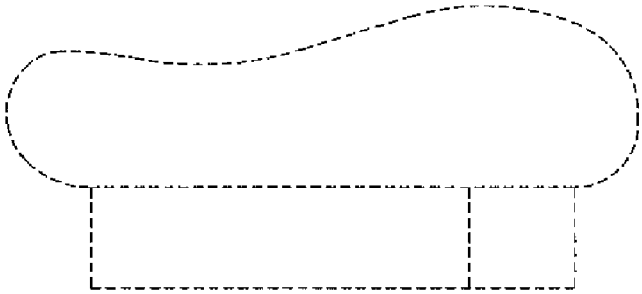
FIG. 18 is a first top view thereof.
Figure 19:
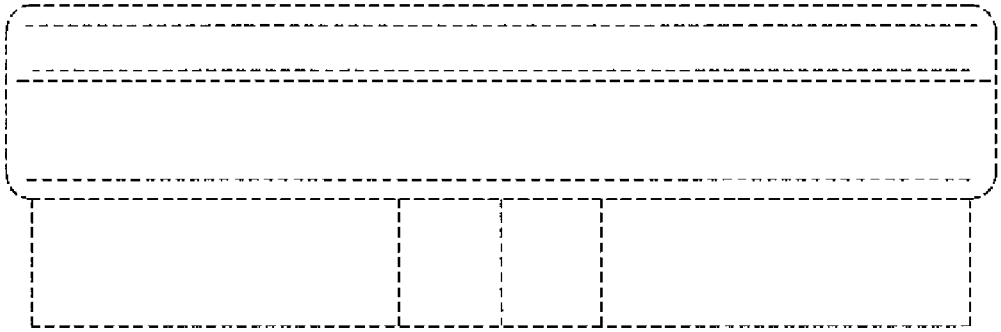
FIG. 19 is a second side view thereof.
Figure 22:
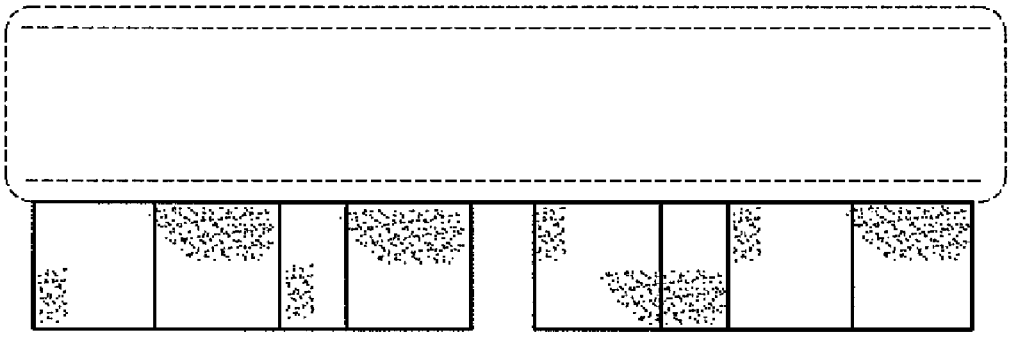
FIG. 22 is a first front view thereof.
Figure 23:
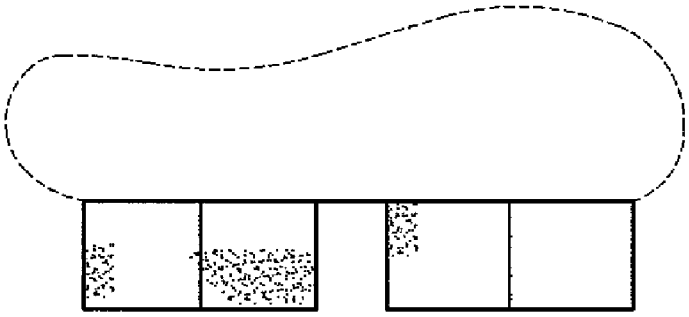
FIG. 23 is a first top view thereof.
Figure 24:
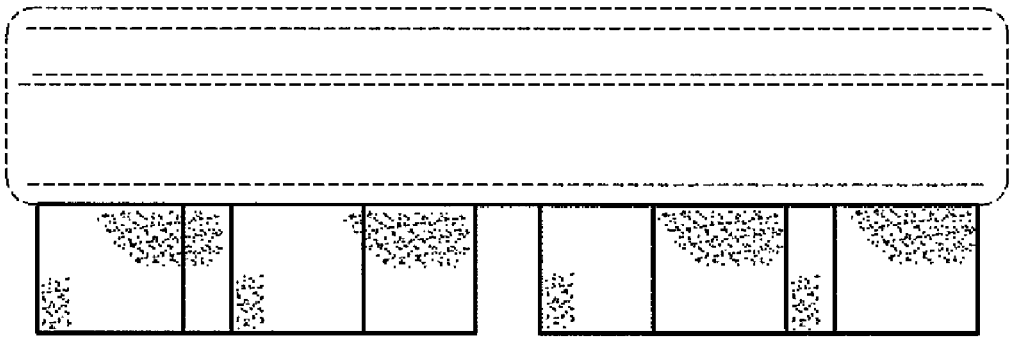
FIG. 24 is a second side view thereof.
Figure 27:
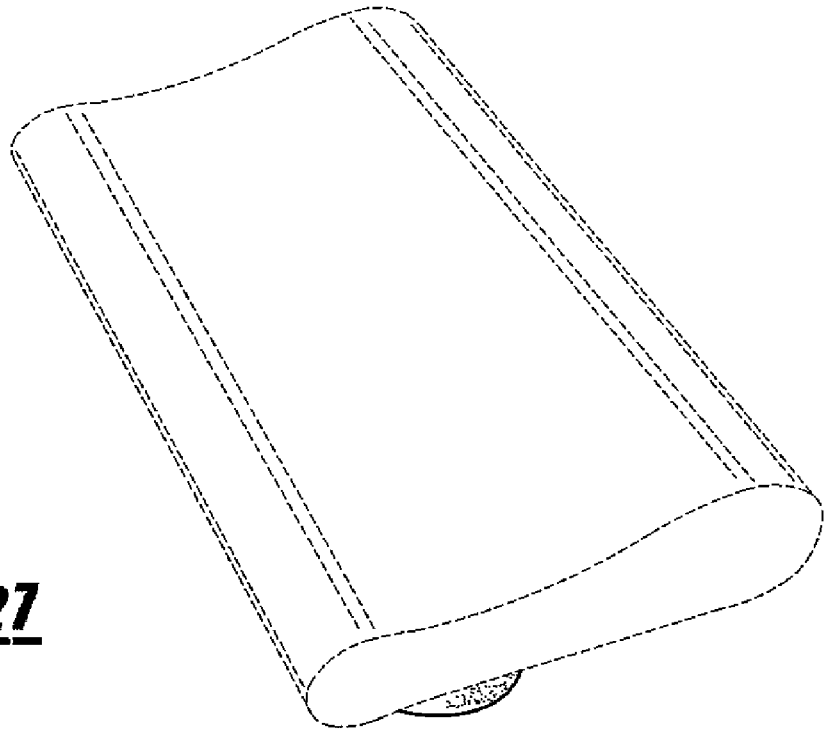
FIG. 27 is a first perspective view thereof.
Figure 28:
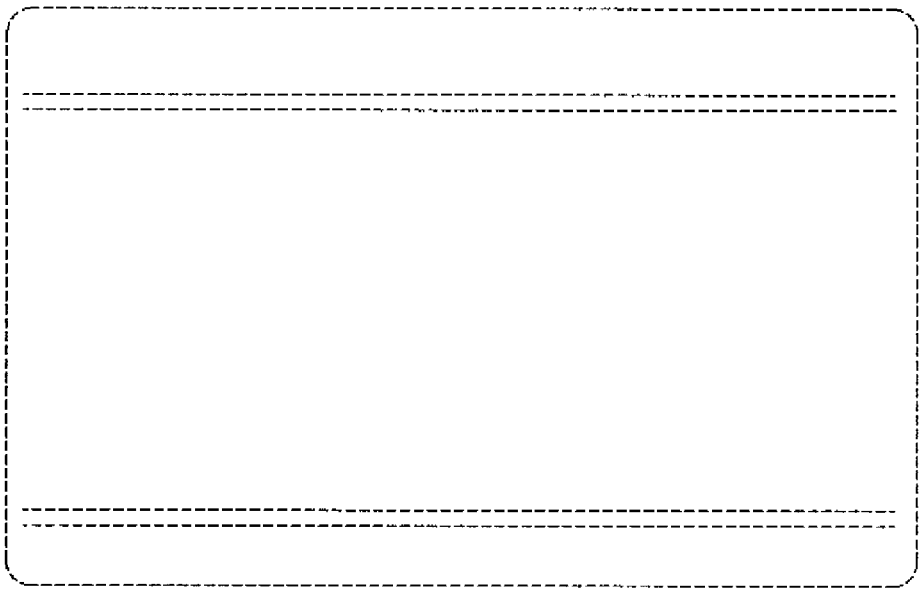
FIG. 28 is a first side view thereof.
Figure 29:
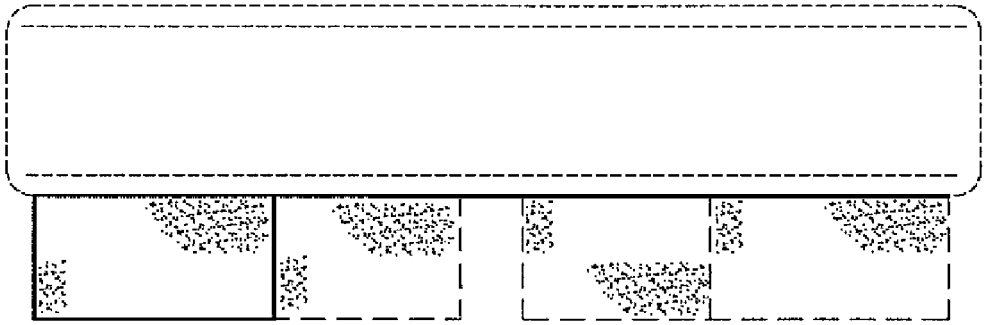
FIG. 29 is a first front view thereof.
Figure 30:
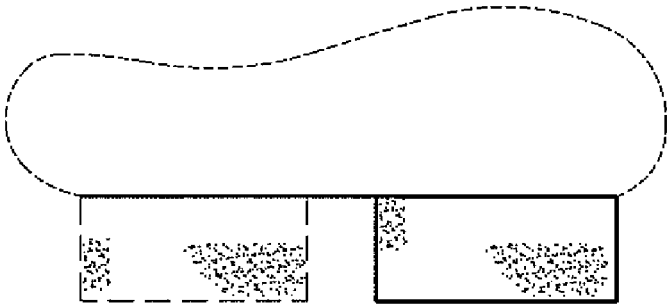
FIG. 30 is a first top view thereof.
Figure 31:
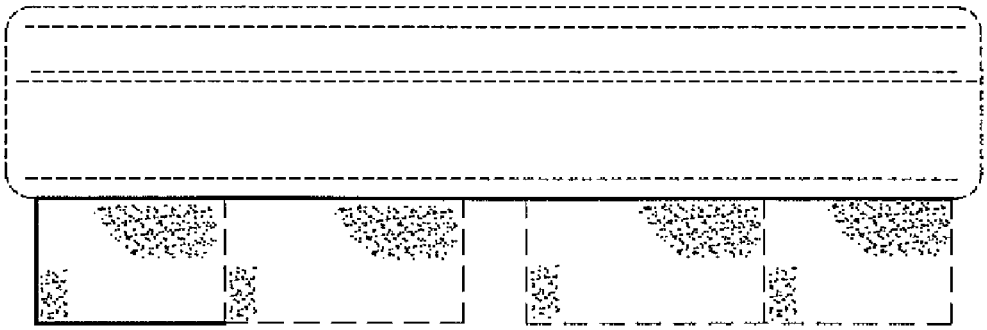
FIG. 31 is a second side view thereof.

Referring now to FIG. 14 in particular there is shown a bottom view of a side sleeper therapeutic pillow 10 having a further alternate support base configuration similar to that shown in FIG. 7 but including an additional central channel 33 splitting the base member 24 into first portion 24*a* and second portion 24*b*. As shown in FIG. 14, base members (or supports) 24*a*, 24*b*, 25 and 26 are disclosed as having a generally triangular shapes. The central channel 33, together with the first and second recesses 41 and 42, provides multiple, generally v-shaped recesses in which the arms of a sleeper may pass along the X-direction of the pillow and at angles of approximately 45 degrees from the X-direction. This provides a sleeper with much greater flexibility in obtaining a more comfortable sleep position while still providing the sleeper's head with adequate support.

It is important to note that the construction and arrangement of the elements of the therapeutic pillow as shown in the preferred and other exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength, comfort and/or durability and in any of a wide variety of colors, textures and combinations. Accordingly, all such modifications are intended to be included within the scope of the present innovations. Other substitutions, modifications, changes and omissions may be made in the design, operating conditions and arrangement of the preferred and other exemplary embodiments without departing from the spirit of the present innovations.

What is claimed is:

1. An arm positioning pillow comprising:

a pillow top portion for supporting a sleeper's head, wherein the pillow top portion includes a top surface and a generally planar lower surface and the pillow top portion is formed from a material having a first resiliency;

a plurality of separate base portions adjacent the pillow top portion lower surface for supporting the pillow top portion and formed from a material having a second resiliency that is less than the first resiliency of the pillow top portion material to support the pillow top portion, wherein the base portions are positioned to define a first recess extending at a first angle from one inlet formed below a front edge of the pillow top portion towards a rear edge of the pillow top portion and a second recess extending at a second angle divergent to the first angle, from the one inlet formed below the front edge of the pillow top portion towards the rear edge of the pillow top portion, so that an arm of the sleeper is repositionable between the first recess and the second recess relative to the sleeper's head without removing the arm of the sleeper from the positioning pillow.

2. The pillow of claim 1 wherein a first recess extends at an angle of between thirty and sixty degrees from a direction of sleep.

3. The pillow of claim 1 wherein a first recess extends at an angle of between forty and fifty degrees from a direction of sleep.

4. The pillow of claim 1 wherein a first recess extends at an angle of forty-five degrees from direction of sleep.

5. The pillow of claim 1 wherein the first and second recesses each have a height and a width for accommodating an arm of the side sleeper.

6. The pillow of claim 1 wherein the base portions are positioned to form a recess extending along a front lower portion of the pillow top portion and offset inwardly from a front upper portion of the pillow top portion.

7. A therapeutic pillow comprising:

a pillow top portion for supporting a sleeper's head, wherein the pillow top portion includes a top surface and a generally planar lower surface and the pillow top portion is formed from a material having a first resiliency;

a base portion adjacent the pillow top portion formed from a material having a second resiliency that is less than the first resiliency of the pillow top portion material for supporting the pillow top portion, wherein the base portion includes a separate first support member protruding vertically from the top portion, a separate second support member protruding vertically from the top portion, and a separate third support member protruding vertically from the top portion, wherein the first support member, the second support member, and the third support member are arranged to define one inlet opening, first recess extending from the one inlet opening at a first angle and a second recess extending from the one inlet opening at a second angle that divergent to the first angle for repositioning an arm of the sleeper between the first recess and the second recess proximal the sleeper's head while using the pillow without removing the arm from the pillow from the positioning pillow.

8. The pillow of claim 7 wherein the first support member is located at the center of the longitudinal edge of the pillow top portion.

9. The pillow of claim 7 wherein the second support member is located at the left center of the lateral edge of the pillow top portion and the third support member is located at the right center of the lateral edge of the pillow top portion.

10. The pillow of claim 7 wherein the second support member is located at the left corner of the pillow top portion distally from the first support member and the third support member is located at the right corner of the pillow to portion distally from the first support member.

11. The pillow of claim 7 wherein the first support member, second support member and third support member each have a generally triangular shape.

12. The pillow of claim 7 wherein the base portions are positioned to form a recess extending along a front lower portion of the pillow top portion and offset inwardly from a front upper portion of the pillow top portion.

* * * * *